US005540029A

United States Patent [19]

Elias

[11] Patent Number: 5,540,029

[45] Date of Patent: Jul. 30, 1996

[54] WIND-RESISTANT ROOF TILE

[76] Inventor: Albert S. Elias, 8820 SW. 149th St., Miami, Fla. 33176

[21] Appl. No.: 197,127

[22] Filed: Feb. 16, 1994

Related U.S. Application Data

[63] Continuation-in-part of Ser. No. 17,399, Feb. 12, 1993, abandoned.

[51] Int. Cl.[6] ..... E04D 1/12

[52] U.S. Cl. ..... 52/536; 52/521; 52/541; 52/542

[58] Field of Search ..... 52/536, 539, 541, 52/542, 521

[56] References Cited

U.S. PATENT DOCUMENTS

| | | | |
|---|---|---|---|
| 318,872 | 5/1885 | Crabbe | 52/536 |
| 651,873 | 6/1900 | Ludowici | 52/536 |
| 718,284 | 1/1903 | Sharp et al. | 52/542 |
| 954,520 | 4/1970 | Kester | 52/536 |
| 1,986,739 | 1/1935 | Mizze | 52/539 |
| 2,114,450 | 4/1938 | Maclean | 52/541 |
| 2,398,632 | 4/1946 | Frost et al. | 52/539 |

FOREIGN PATENT DOCUMENTS

| | | | |
|---|---|---|---|
| 142970 | 8/1951 | Australia | 52/536 |
| 819014 | 6/1937 | France | 52/541 |
| 827247 | 1/1952 | Germany | 52/536 |
| 216618 | 2/1942 | Switzerland | 52/536 |
| 237460 | 7/1925 | United Kingdom | 52/539 |

*Primary Examiner*—Michael Safavi
*Attorney, Agent, or Firm*—Fish & Richardson P.C.

[57] ABSTRACT

A roof tile 10 is provided which, when used on a tiled roof, has improved resistance to lifting and damage due to wind. The roof tile includes a wind-uplift-preventing step 5 that, when a plurality of the tiles are overlapped on a roof deck, shields a forward end surface 94 of an adjoining tile to prevent the adjoining tile from being lifted in high winds. The roof tile also has a tapered top surface 93 which offers a low wind resistance profile, and includes interlocking formations 28, 40 on its top and bottom surfaces which are arranged and dimensioned to allow each tile to be interlocked with adjoining tiles above and below it on the roof deck.

11 Claims, 11 Drawing Sheets

500
501
502
503
504
505
506
507
508
999

WIND-RESISTANT ROOF TILE

CROSS REFERENCE TO RELATED APPLICATIONS

This application is a continuation-in-part of U.S. Ser. No. 08/017,399, filed Feb. 12, 1993 now abandoned.

BACKGROUND OF THE INVENTION

The invention relates to roof tiles.

There are a variety of roof tiles available on the market today. Many different materials are used in the manufacture of roof tiles, including fiberglass, asphalt, clay and cement. Roof tiles are generally adhered to the roof deck, and to each other in conventional overlapping fashion, using masonry cement or other adhesive or cementitious material. Regardless of the material of which the roof tiles are made, or the manner in which they are attached, however, most commercially available roof tiles are susceptible to lift and damage when the roof is subjected to high winds. Hurricane force winds have in some cases even caused the loss of an entire tiled roof.

SUMMARY OF THE INVENTION

The present invention features a roof tile which, when used on a tiled roof, has improved resistance to lifting and damage due to wind. The roof tile includes a wind-uplift-preventing step that, when a plurality of the tiles are overlapped on a roof deck, shields a forward end surface of an adjoining tile to prevent the adjoining tile from being lifted in high winds. The roof tile also has a tapered top surface which offers a low wind resistance profile. Preferably, the tile includes interlocking formations on its top and bottom surfaces which are arranged and dimensioned to allow each tile to be interlocked with adjoining tiles above and below it on the roof deck. These interlocking surfaces enhance the bond between adjoining roof tiles and the masonry cement or other bonding material which joins them. Preferably, the interlocking formations are a downwardly extending protuberance and an upwardly facing indentation.

The wind-uplift-preventing step shields the forward end surface of the overlapping tile so that wind is prevented from entering the space between the overlapping tiles, and thereby lifting the upper tile.

The roof tile may also include a lateral protuberance extending along the side of the tile and mating with a matching lateral indentation along the side of an adjoining tile.

The wind-uplift-preventing step is preferably shaped to provide a recess that works in conjunction with the forward end surface of an overlapping tile to retard upward lifting of the forward end of the overlapping tile. Preferably, the forward end surface is shaped to extend into the recess formed by the wind-uplift-preventing step. In this way a portion of the forward end surface of the overlapping roof tile is captured vertically beneath a portion of the wind-uplift-preventing step, thereby assuring that the roof tile is prevented from being vertically lifted by the wind.

The forward end surface and wind-uplift-preventing step may be inclined surfaces, each inclined so that in the assembly of tiles the inclined surfaces are substantially parallel. Preferably, the angle of inclination is between 45° and 85°.

The forward end surface and wind-uplift-preventing step may be curved and the forward end surface make a bull nose fit with the recess formed by the step.

The exposed top surface of the forward portion of the tile may be curved to provide a more aerodynamically smooth surface to the wind.

Adhesive is preferably applied between the interlocking formations, and at the wind-uplift-preventing step.

The tile may be made from a variety of materials, including masonry material, composites (e.g., plastics and polymer composites), and metals (e.g., aluminum). If masonry material is used, a masonry adhesive (masonry cement, mortar, "mud", or mastic) may be used. Other types of adhesives would be used with composite materials.

The roof tile is preferably made from a substantially rigid material. But if made from appropriate materials, the tile may be of a thin-wall construction with a hollow interior. The thin walls (e.g., of composite or aluminum) may be welded or bonded together.

With a masonry tile, the masonry cement is preferably applied between the first and second interlocking formations and between the wind-uplift-preventing steps and the forward end surfaces. The cement, rather than the forward end surface, may be what extends into the recess provided by the wind-uplift-preventing step.

The wind-uplift-preventing steps and the forward end surfaces are preferably shaped and configured so that there are substantially no spaces into which air can enter at the junctions between the wind-uplift-preventing steps and the forward end surfaces.

The wind-uplift-preventing steps shield not only the forward end surface, but as importantly, the joint between the bottom and top surfaces of overlapping tiles, thereby preventing wind from entering at the joint and separating the tiles.

The tiles of the invention are preferably not of the "gutter tile" design, in which water is allowed to flow between the tiles, and through gutters formed by laterally extending projections of the tile. Preferably, the first and second interlocking formations are shaped and positioned so that water flowing down the assembly of tiles on the sloped roof does not flow along or through these formations. Preferably, adhesive applied between the tiles blocks entry of water into spaces between the first and second interlocking formations.

The downwardly-extending protuberance and upwardly facing indentation may extend transversely across substantially the full width of the tile.

Preferably, the downwardly extending protuberance has a dimension along the length of the tile of between 0.5 and 2.0 inches, more preferably between 0.75 and 1.5-0 inches.

Preferably, the downwardly extending protuberance has a depth of between 0.25 and 1.0 inches, more preferably between 0.40 and 0.80 inches.

In further aspects, particularly suited for roof tiles constructed of composite materials, the invention features interlocking formations of several forms. A peg-shaped protuberance may extend downwardly from the bottom surface of the tile for interlocking with a mating hole on another tile. The peg-shaped protuberance and mating hole are shaped so that the protuberance can be inserted into the hole without deformation of the protuberance or hole. This allows the tile to be constructed of substantially rigid material. Preferably, more than one peg-shaped protuberance and mating hole are provided. Alternatively, the interlocking formation may comprise a pair of curved clips oriented in a V-formation and configured to interlock with a raised V-shaped formation in another tile. Fore and aft extending formations may also be used as the interlocking formations; a forward extending fore and aft protuberance mates with a rearward opening indentation of another roof tile.

Other features of the invention will be apparent from the following description of preferred embodiments and from the claims.

DESCRIPTION OF THE PREFERRED EMBODIMENTS

Figure 1:
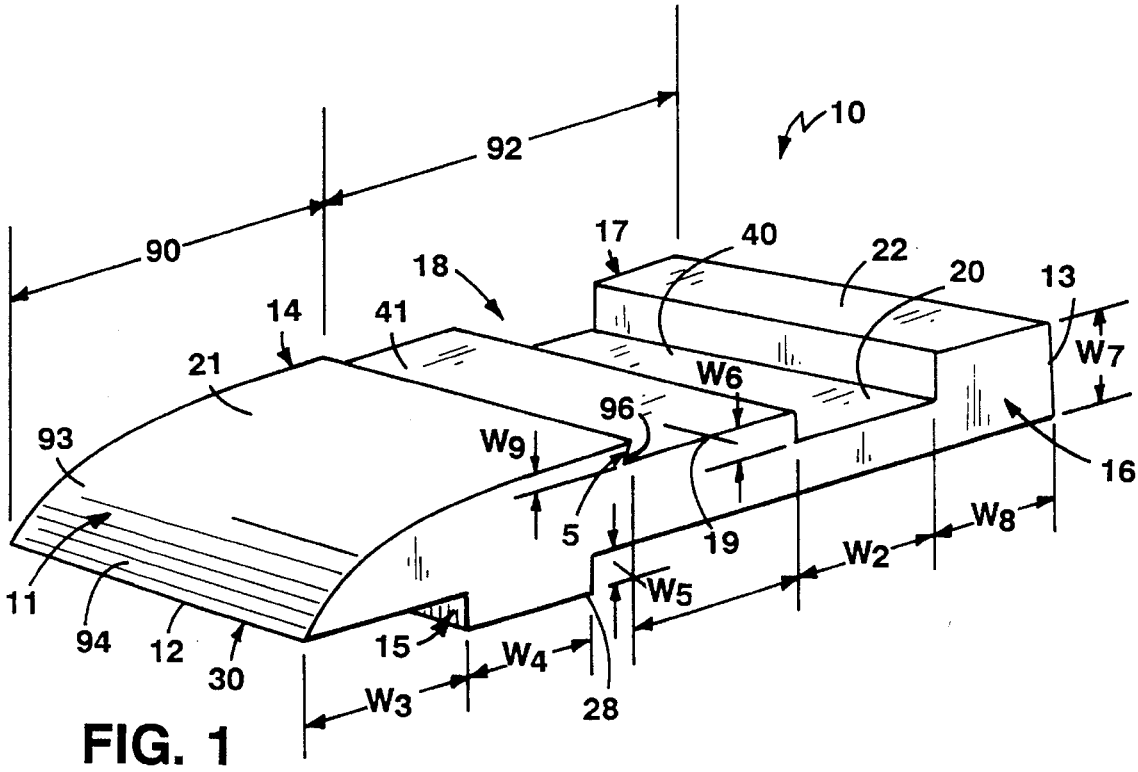
FIG. 1 is a perspective view of a roof tile according to one embodiment of the invention.
Figure 2:
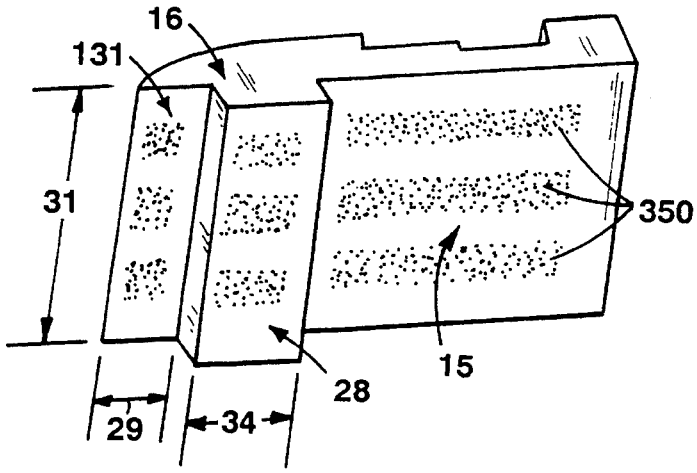
FIG. 2 is a bottom view of the roof tile of FIG. 1.

Referring to FIGS. 1 and 2, roof tile 10 (e.g., of masonry material) includes a body 11, having end surfaces 12, 13, top and bottom surfaces 14, 15, and side surfaces 16, 17.

Top surface 14 includes an exposed top surface 21 and rear surfaces 41, 22, separated by an indentation 18 that extends from side surface 16 to side surface 17. Indentation 18 has a stepped bottom with steps 19, having a width W1, and step 20, having a width W2 and depth W6. Step 19 terminates in uplift preventing step 5, of height W9.

Bottom surface 15 includes a protuberance 28 located a distance W3, substantially equal to W1, from leading edge 30 of front end surface 12. Protuberance 28 extends from side surface 16 to side surface 17, and has a width W4, slightly smaller than W2, and a depth W5 slightly less than W6. Thus, the protuberance is positioned and sized to mate with the stepped indentation of a similar adjoining roof tile.

The tile has a forward portion 90 with an exposed top surface 21, a tapered forward end 93 terminating at a forward end surface 94. The tile also has a rear portion 92 integral with the forward portion and having a top surface (41, 22) shaped to be overlapped by another tile.

As shown in FIG. 2, the bottom surface of roof tile 10 preferably includes roughened areas 350 to improve the adhesion of the bonding material (e.g., masonry cement) to the bottom surface.

Figure 3:
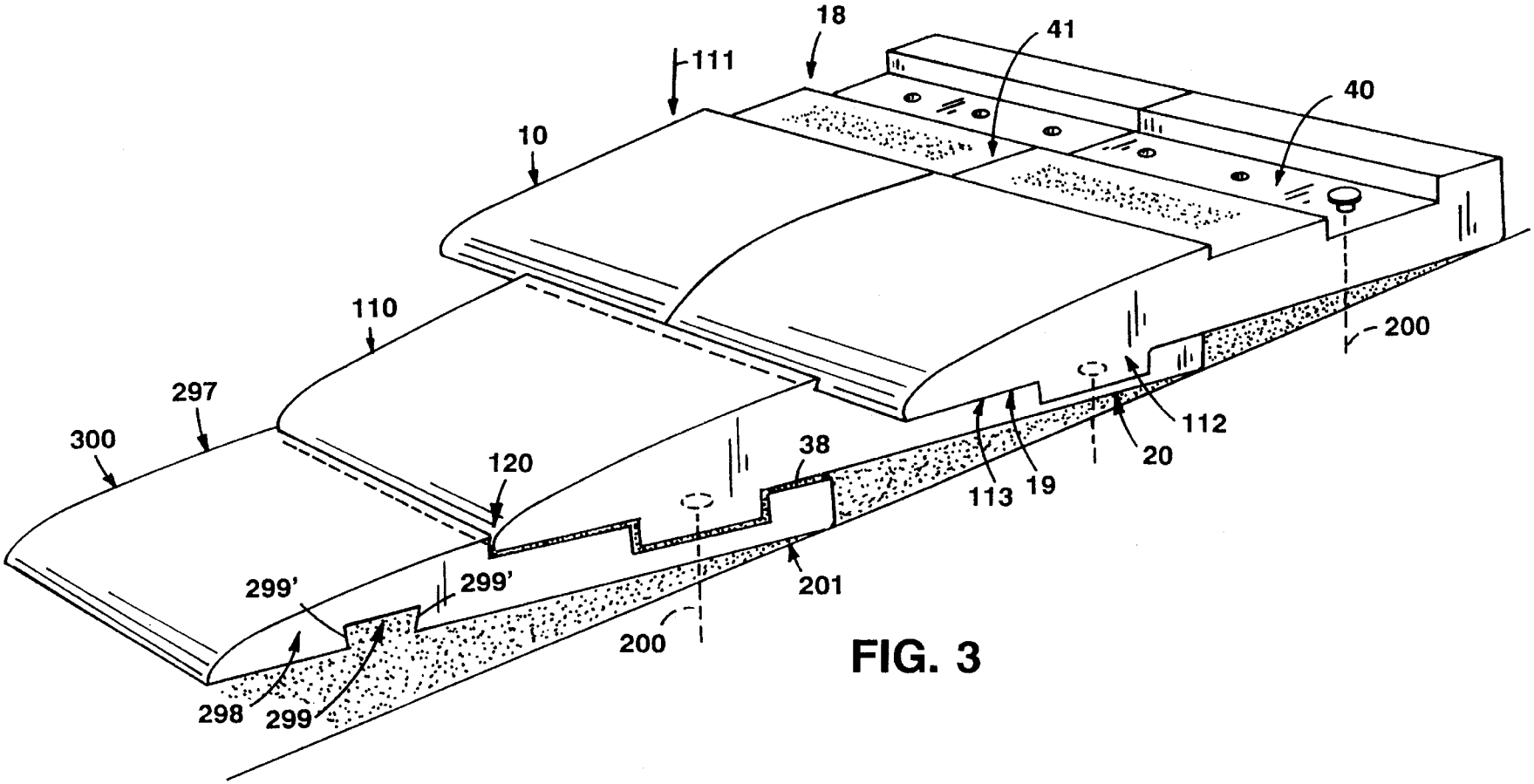
FIG. 3 is a perspective view of a portion of a tiled roof including a plurality of tiles according to the embodiment of the invention shown in FIG. 1.

Referring now to FIG. 3, in operation the tiles are arranged in an overlapping manner so that the protuberance of one tile is received by a corresponding indentation of an underlying tile.

The tiles are interlocked by pressing a first tile 10 down onto an adjoining tile 110, typically by hand, so that protuberance 112 fits snugly into indentation 18 and contacts top surface 40 of step 20, while bottom section 113 fits snugly into indentation 18 and contacts top surface 41 of step 19. Prior to placement of tile 10 onto tile 110, nails 200 are hammered through top surface 40 into the underlying tile support 201.

In one embodiment, not illustrated, there is no bonding material interposed between adjoining tiles, and thus there is a pressure fit between the interlocking formations.

Figure 3A:
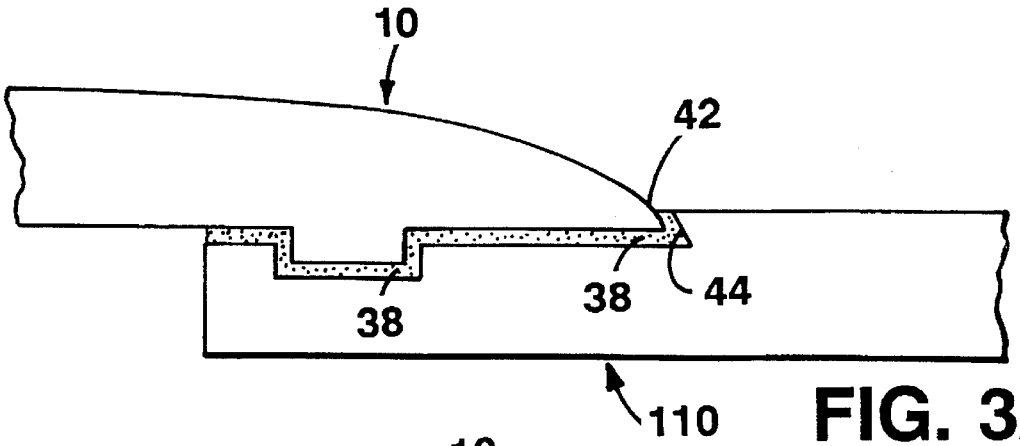
FIGS. 3*a*–3*d* are highly enlarged detail views showing the interlocking engagement of two tiles (shown schematically in FIG. 3) according to four embodiments of the invention.
Figure 3B:
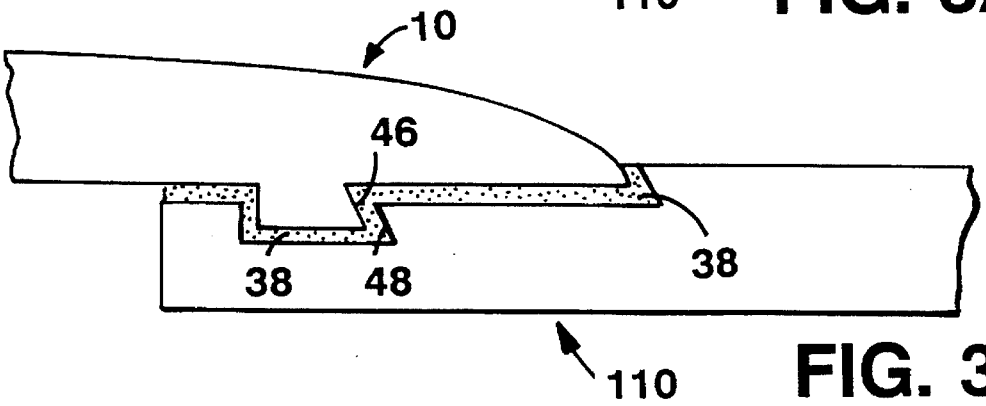
Figure 3C:
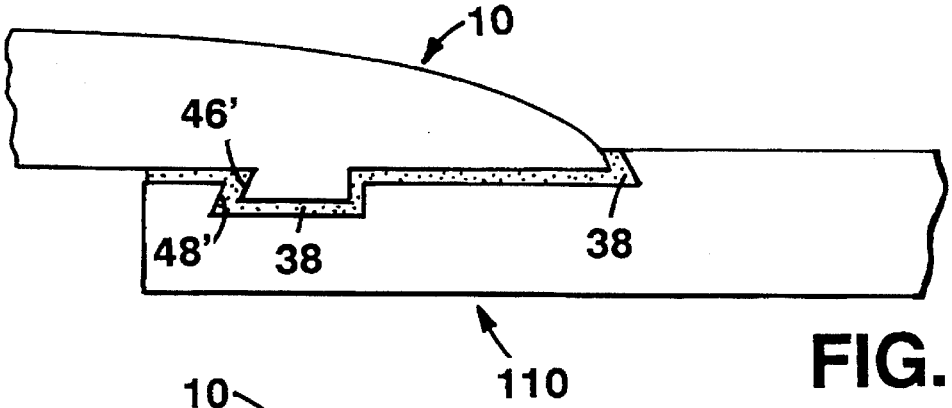
Figure 3D:
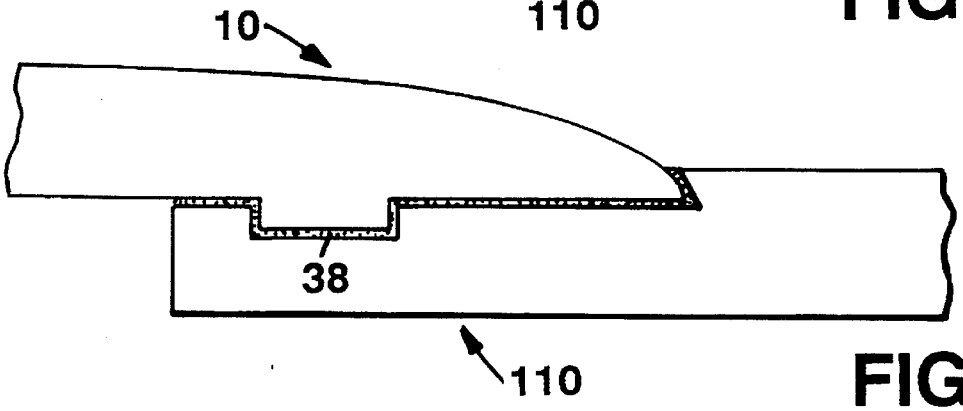
Figure 6:
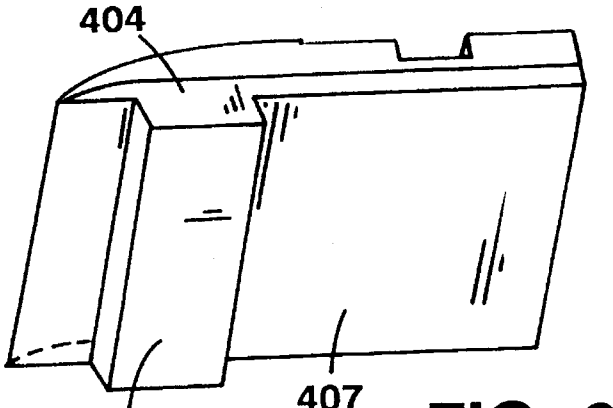
FIGS. 6, 7 and 7*a* are perspective view of the roof tile of FIG. 5 taken from various directions.
Figure 5:
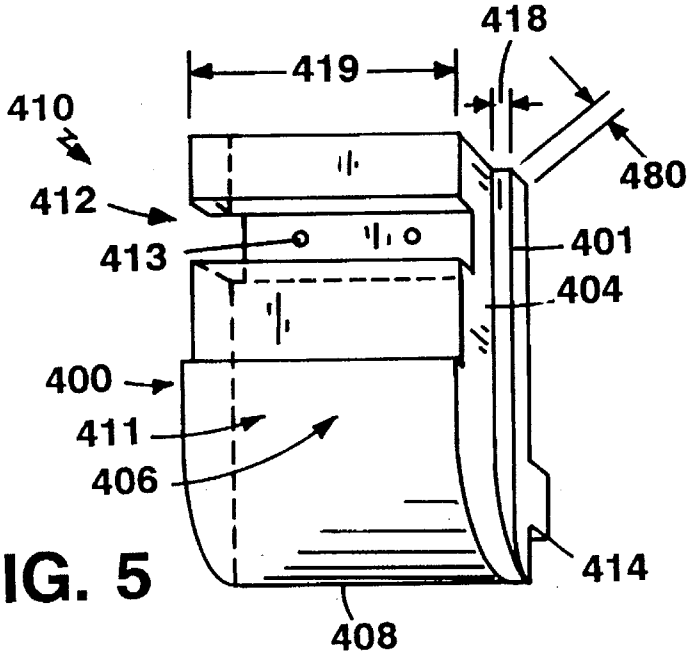
FIG. 5 is a perspective view of a roof tile according to yet another embodiment of the invention.
Figure 7A:
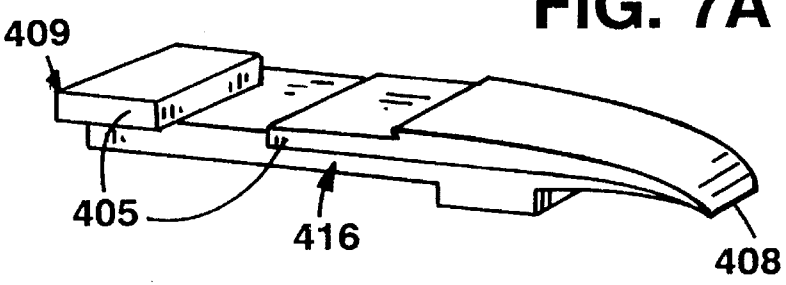
Figure 7:
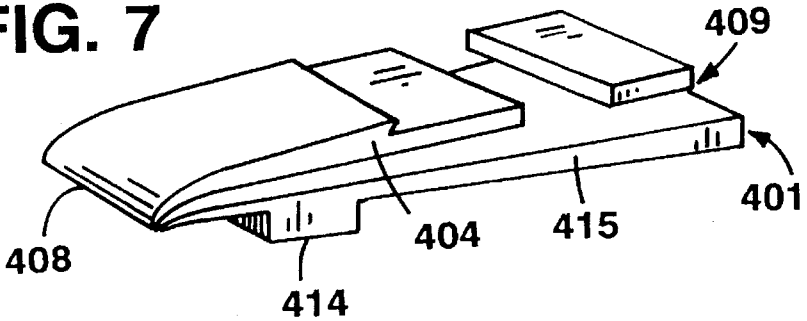

Preferably, however, as shown in FIGS. 3*a*–3*d*, a layer 38 of masonry cement or other bonding material is applied to each indentation and to the vicinity of the wind-uplift-preventing, step, before the upper tile is installed. Thus, the roof tiles are held together by the bonding material, rather than simply by a pressure fit, and the interlocking engagement of the protuberance and the indentation serves to enhance the adhesion of the bonding material. The bond between adjoining tiles is also enhanced by the forward end surface of one tile fitting into a recess under the wind-uplift-preventing step of the tile in front of it in a "bull-nose fit" (FIG. 3*d*). Thus, a portion of the forward end surface of the upper tile is captured vertically beneath a portion of the wind-uplift-preventing step on the lower tile, as indicated by reference numeral 120 in FIG. 3, preventing wind uplift. Alternatively, as illustrated in FIGS. 3*a*–3*c*, the forward end surface need not extend into the recess provided by the wind-uplift-preventing step when masonry cement or mortar (or other adhesive filler) is used, as the cement extends into the recess.

In all three figures, the forward end surface of the upper tile, and the wind-uplift-preventing step of the lower tile have surfaces 42, 44 which are inclined at an angle of about 70° with respect to the bottom surface and top surface, respectively, of the respective roof tiles. Thus, when two adjoining roof tiles are interlocked as shown, inclined surfaces 42, 44 are spaced apart, and only the masonry cement or mortar extends beneath the wind-uplift-preventing step.

This provision of the wind-uplift-preventing step and tapered forward portion improves the wind profile of the tiles and increases the strength of the bond in the area between the front end surface and wind uplift preventing step. In FIG. 3*a*, the surfaces of the protuberance and the indentation are not inclined, as shown also in FIG. 1. In FIGS. 3*b* and 3*c*, preferred embodiments are shown, in which surfaces 46, 48 (FIG. 3*b*) or 46', 48' (FIG. 3*c*) are inclined at an angle of about 70° with respect to the bottom surface of the upper tile and the top surface of the lower tile, respectively. These inclined surfaces enhance the interlocking engagement between the interlocking formations and, when a bonding material is used to join the tiles, as shown, strengthen the bond formed between the interlocking formations and the bonding material which joins them. Although not shown in the drawings, improvement in the interlocking bond between the tiles would also be achieved if only one of the interlocking surfaces (e.g., surface 46 or surface 48 in FIG. 3*b*) were inclined, as the inclined surface provides a better bond with the masonry cement or mortar.

The preferred dimensions of the roof tile shown in FIGS. 1, 3, 3A–3D, 15, and 16 are given in the table below (inches):

| | |
|---|---|
| W1 | 3.0 |
| W2 | 1.5 |
| W3 | 3.0 |
| W4 | 1.25 |
| W5 | 0.4 |
| W6 | 0.5 |
| W7 | 1.25 |
| W8 | 0.75 |
| W9 | 0.25 |
| W10 | 20.0 |
| W11 | 14.0 |

Many variations can be made to these dimensions. Preferably, dimension W4 (width of downwardly extending protuberance) is in the range from 0.5 to 2.0 inches, and most preferably 0.75 to 1.50 inches. Preferably, dimension W7 (tile thickness) is from 0.50 to 2.00 inches, and most preferably 0.75 to 1.50 inches. Preferably, dimensions W6 and W5 (the depths of the protuberance and mating indentation) are in the range of 0.25 to 1.0 inches.

Preferably, the forward end surface 94 is received in the recess 96 formed by the wind-uplift-preventing step (FIG. 3*d*).

Figure 4:
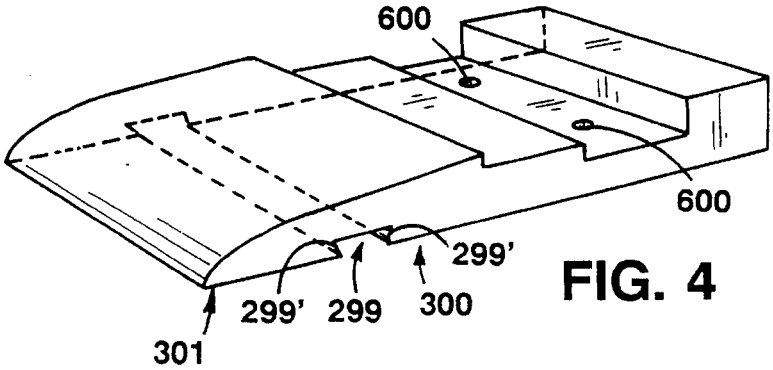
FIG. 4 is a perspective view of a roof tile according to another embodiment of the invention.

The edge tile 300 shown in FIGS. 3 and 4 is identical in construction to the roof tile 10 shown in FIG. 1 except that bottom protuberance 28 of roof tile 10 is omitted in edge tile 300. Instead, bottom surface 301 of edge tile 300 has an indentation 299 extending from the side surface 298 to opposite side surface 297. This indentation acts as a reservoir for bonding material and thus improves the adhesion of the edge tile to the underlying tile support 201. Adhesion is further improved by providing inclined surfaces 299'.

Figure 8:
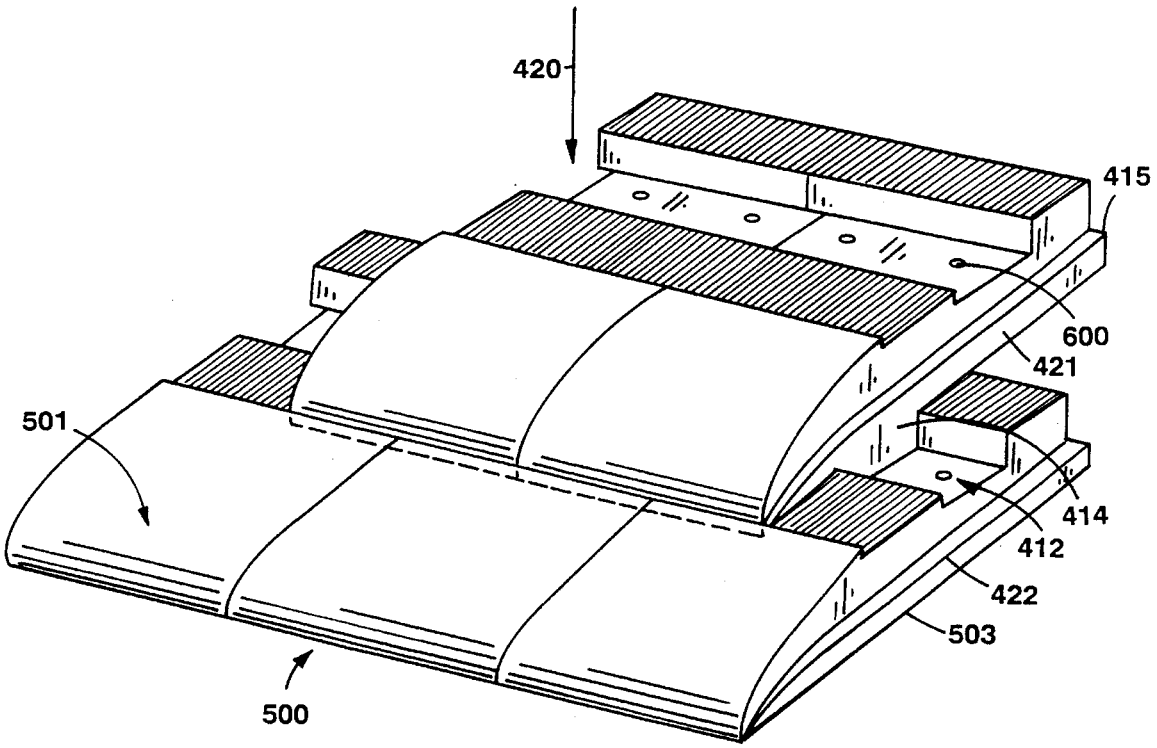
FIG. 8 is a perspective view of a portion of a tiled roof including a plurality of tiles according to the embodiment of the invention shown in FIGS. 5–7*a*.

An alternate embodiment is shown in FIGS. 5–8. In this embodiment, the roof tile includes lateral interlocking features as well as top and bottom interlocking features. Roof tile 410 includes a body 411 having side surfaces 404, 405, top and bottom surfaces 406, 407, and front and rear surfaces 408, 409. As in the embodiment shown in FIG. 1, top surface 406 has an indentation 412 that extends from side surface 404 to opposite side surface 405, and bottom surface 407 has a protuberance 415 that extends from front surface 408 to rear surface 409. In this embodiment, however, side surface 404 has a lateral protuberance 415 which extends laterally along the length of the roof tile from front surface 408 to rear surface 409, while opposite side surface 405 has a lateral indentation 416 which also extends from front surface 408 to rear surface 409. The lateral indentation and lateral protuberance are dimensioned to interlock with lateral protuberances and indentations, respectively, on similar adjoining tiles, as shown in FIG. 8.

The tiled roof shown in FIG. 8 is assembled using either of the techniques described above in connection with FIG. 3, except that in the roof shown in FIG. 8 the lateral protuberances and indentations of adjoining tiles are interlocked, in addition to the bottom protuberances and top indentations.

Figures 9, 9A, 9B, 9C:
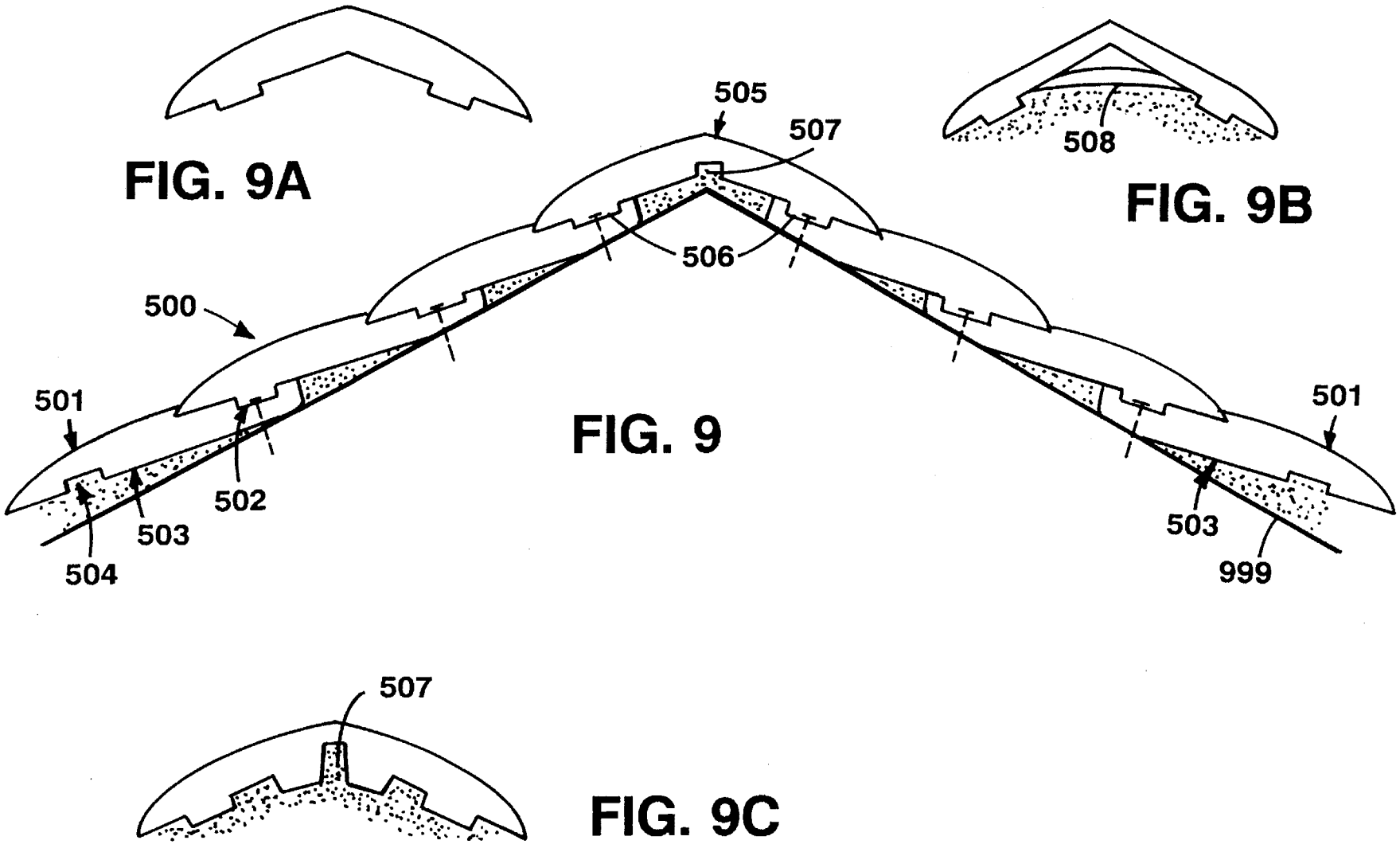
FIG. 9 is a side view of a tiled roof according to one embodiment of the invention.
FIGS. 9*a*–9*c* show side views of crown tiles according to various embodiments of the invention.

As shown in FIG. 9, the tiled roof preferably includes a roof crown tile 505 which spans both sides of the crown of the roof, and thus includes a bottom protuberance 506 on each side, each of which is dimensioned to interlock with the top indentations in the uppermost roof tile on either side of the roof. Crown tile 505 also preferably includes an indentation 507 (FIG. 9*c*) which serves as a reservoir for receiving the bonding material. However, as shown in FIGS. 9*a*–9*c*, the crown tile 505 can have alternate configurations. In FIG. 9*a*, the crown tile does not have an indentation 507; in FIG. 9*b*, the crown tile includes, instead of an indentation, a roof pitch accommodating member 508.

Figure 17:
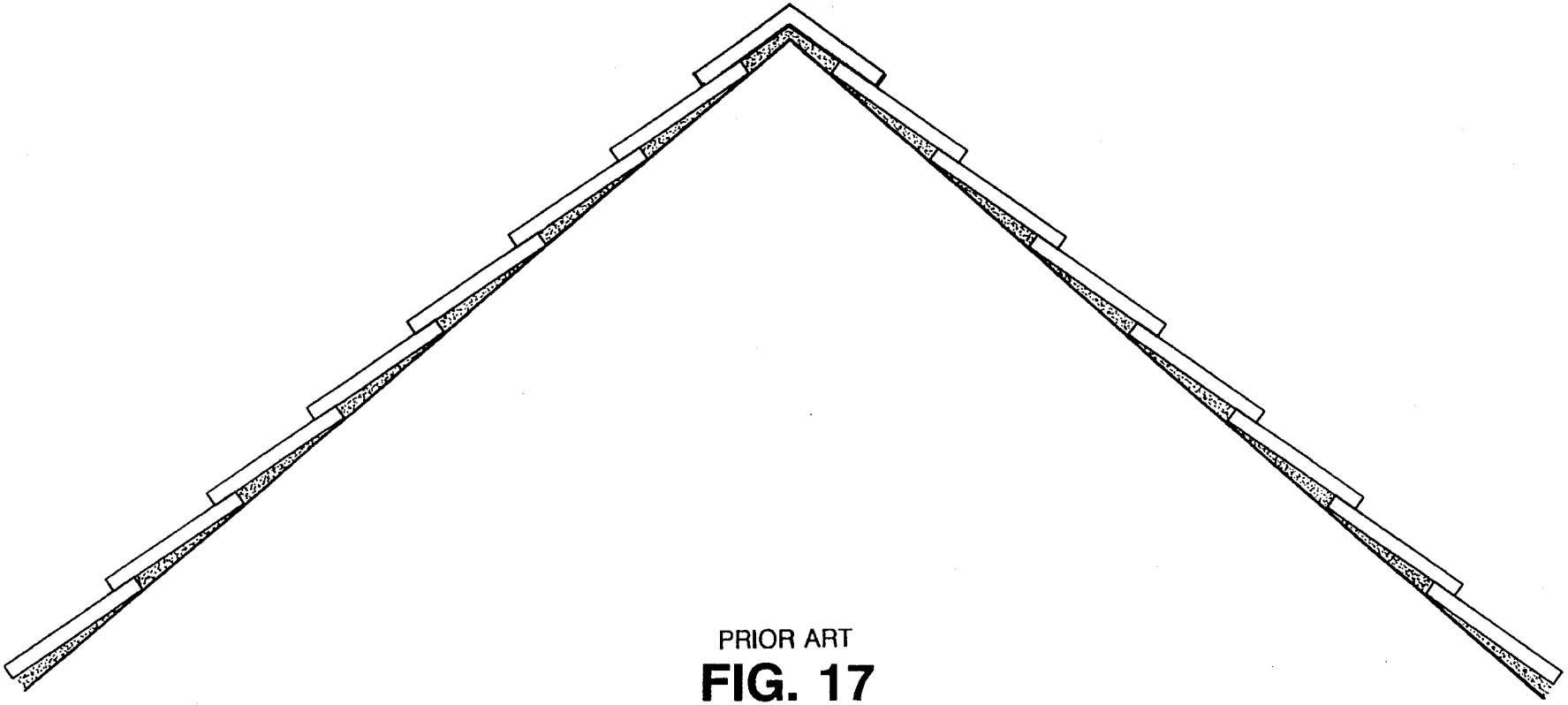
PRIOR ART FIG. 17
FIG. 17 is an elevation view of an assembly of prior art roof tiles on a sloping roof.

FIG. 17 shows a roof tiled with conventional tiles, each of which has a simple, rectangular cross section. The prior art tiles have none of the features of the invention (e.g., the wind-uplift-preventing step, the interlocking formations).

Figures 10, 10A, 10B:
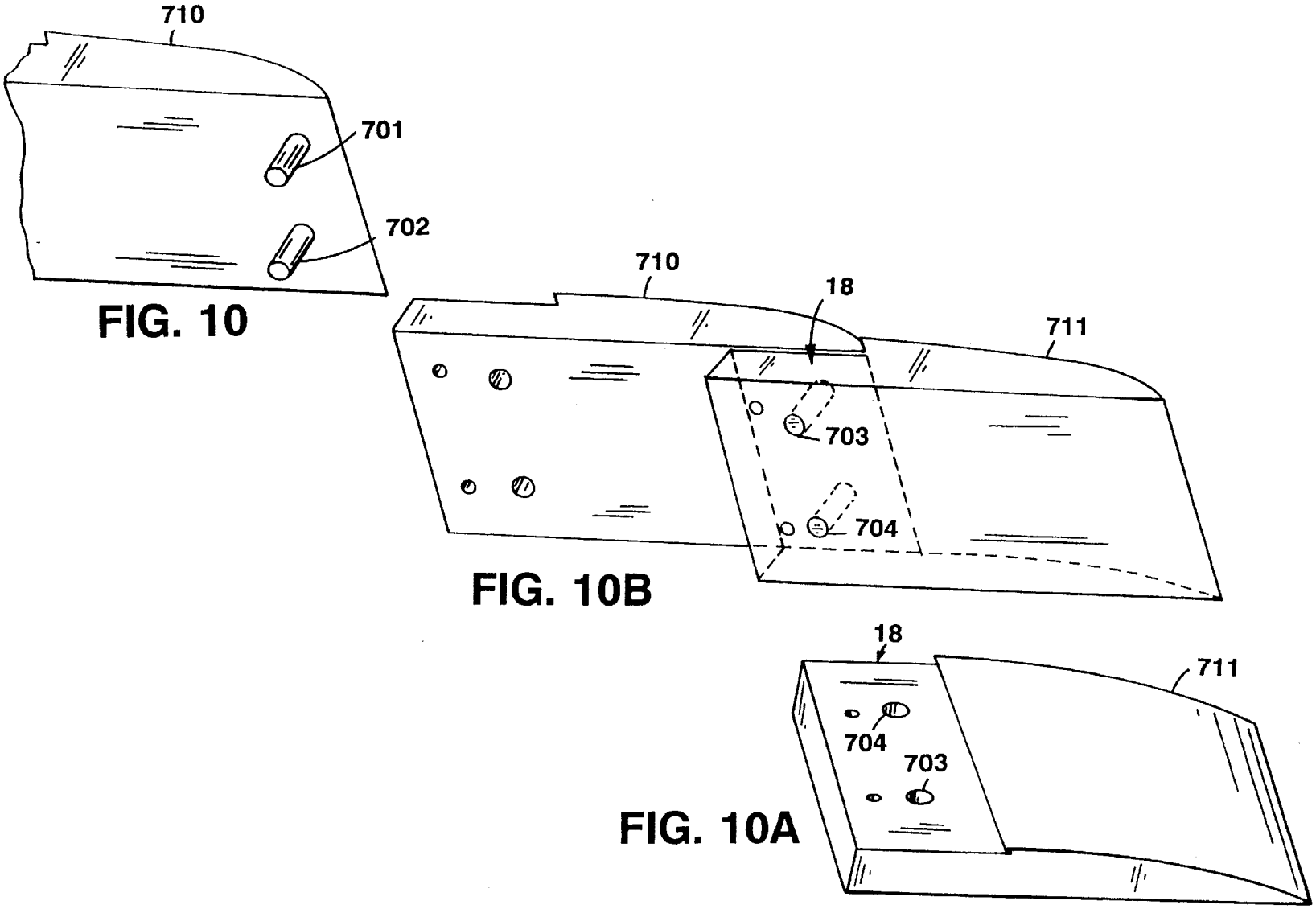
FIGS. 10 and 10*a* are perspective views of a roof tile according to another embodiment of the invention, taken from below and above, respectively.
FIG. 10*b* is a perspective view of two roof tiles of FIG. 10 in interlocking engagement.

A roof tile according to another embodiment of the invention is shown in FIGS. 10–10*b*. In this embodiment, the protrusion and indentation of FIG. 1 are replaced by cylindrical peg members 701, 702 and cylindrical holes 703, 704, respectively. The pegs are easily received in holes without the need for deformation of the pegs or holes, thus allowing the use of substantially rigid material.

Figures 11, 11A, 11B:
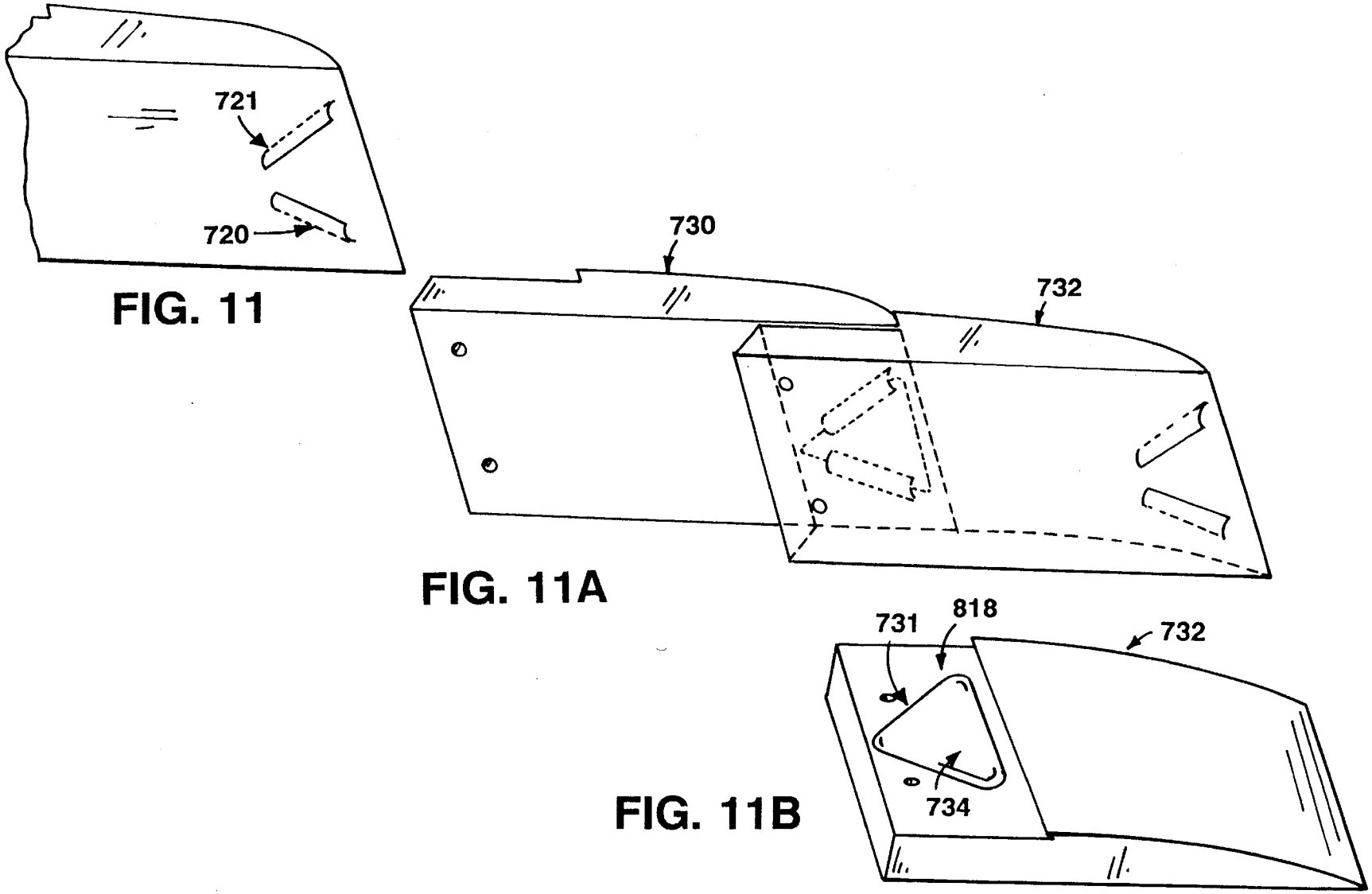
FIGS. 11–11*a* show perspective views of a roof tile according to another aspect of the invention.
FIG. 11*b* shows a perspective view of two roof tiles of FIG. 11 in interlocking engagement.

FIGS. 11–11*c* show another embodiment of the invention, in which the interlocking structures are, instead of the protrusion and indentation of FIG. 1, two curved clips 720, 721 disposed in a V-formation on the bottom surface of tile 730 and dimensioned to receive raised structure 731. Raised structure 731 includes a V-shaped edge 734 which enables the raised structure to engage the curved clips 720, 721 in an interlocking manner. The raised structure is slightly raised above surface 818, e.g., by a post member (not shown), so that clips 720, 721 can slide between surface 818 and structure 731 as shown in FIG. 11*b*.

Figures 12, 12A, 13, 13A, 14:
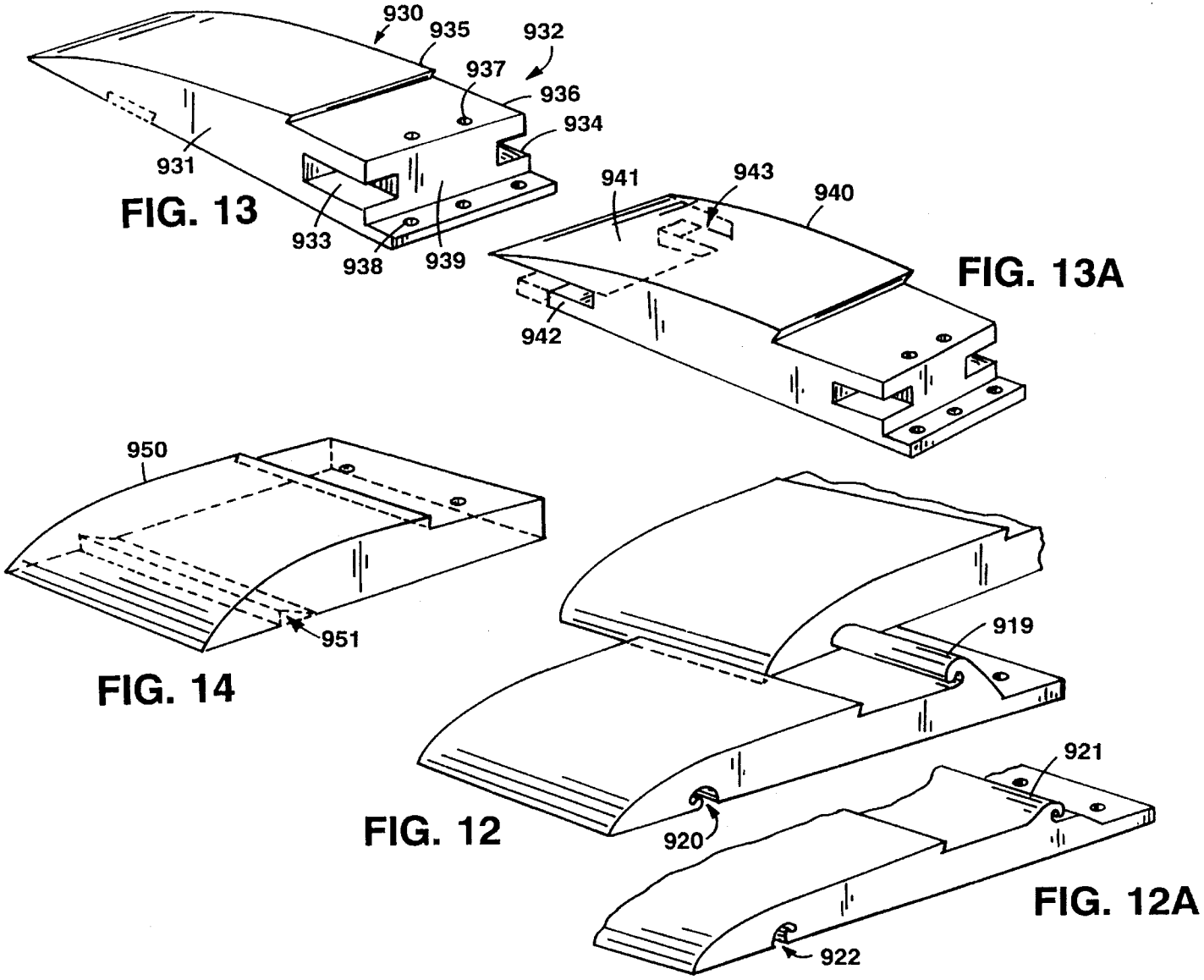
FIG. 12 is a perspective view of a pair of roof tiles according to another embodiment of the invention in interlocking engagement.
FIG. 12*a* shows a partial perspective view of a variation of the embodiment shown in FIG. 12.
FIGS. 13 and 13*a* are perspective views of a pair of interlocking roof tiles according to another embodiment of the invention.
FIG. 14 is a perspective view of an edge tile according to another embodiment of the invention.
Figure 16:
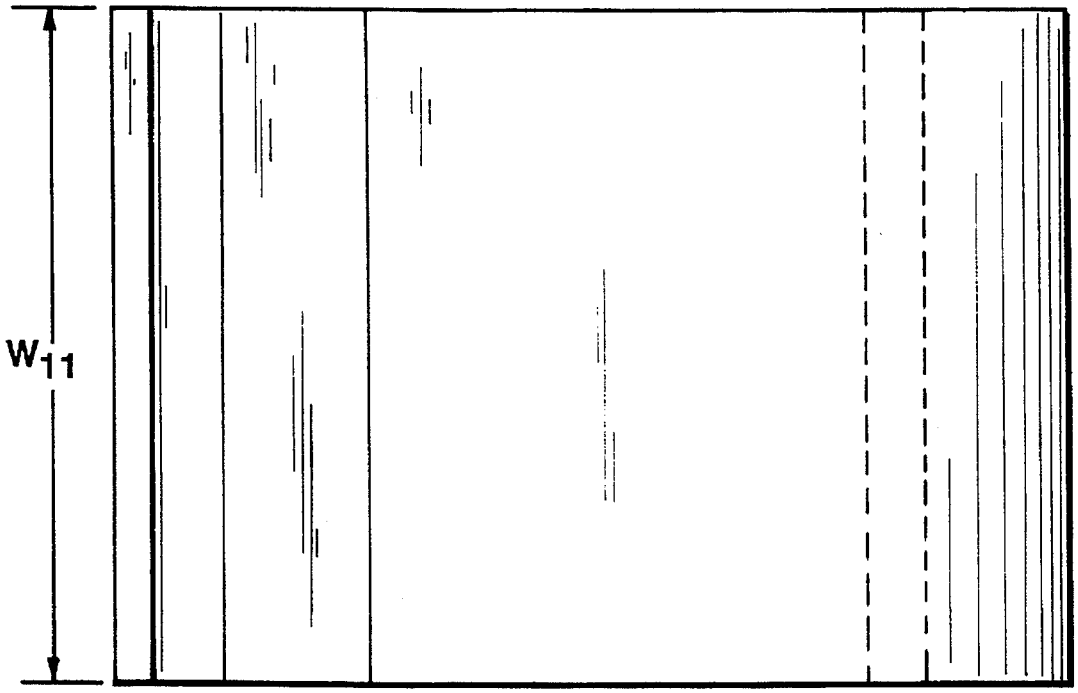
FIG. 16 is a plan view of the roof tile of FIG. 15.
Figure 15:
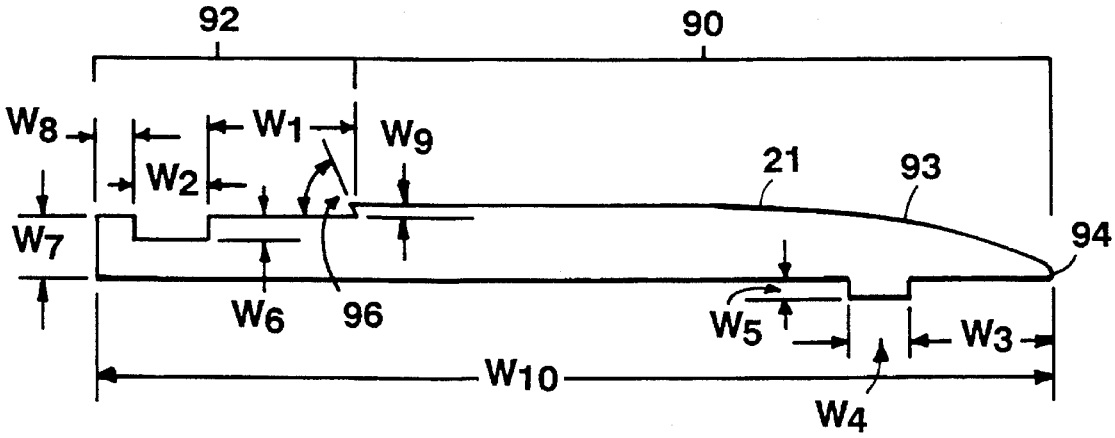
FIG. 15 is a side elevation of the roof tile of FIG. 1 with dimensions shown more closely to scale.

In yet another embodiment, shown in FIG. 12, top surface indentation 918 has a single clip structure 919, which has a "wave-shaped" cross-section and which is shaped to mate with a bottom indentation 920 having a corresponding shape. In FIG. 12*a*, the curve of clip structure 921 and bottom indentation 922 are reversed relative to those shown in FIG. 12.

FIGS. 13 and 13*a* show yet another embodiment, in which side surfaces 931 and 932 include side indentations 933 and 934, respectively, and top surface 935 has an indentation 936. Front end surface 941 includes protuberances 942, 943. The protuberances and side indentations are shaped and dimensioned so that the protuberances on a first tile mate with the indentations on a second similar roof tile in interlocking fashion. As in the other illustrated embodiments, holes 937, 938 allow the tile to be nailed to the underlying roof support surface.

The embodiments of FIGS. 10–10*b*, 11–11*c*, 12–12*a*, and 13–13*a* are generally better suited to being made from composite materials than masonry materials.

While preferred embodiments have been described above, other variations and modifications are within the scope of the following claims. For example, as shown in FIG. 14 the indentation 951 in the bottom surface of the edge tile may have any desired shape, e.g., wedge shaped as shown. The features shown in FIGS. 3*a*–3*d* (inclined surfaces), may be used in any desired combination, e.g., one of the opposed surfaces may be inclined while the other is not, and the angle of the inclined surface(s) may be varied to suit a given application. Further, many different types of interlocking features may be used in place of those shown and described above. As only one example, in each of the embodiments shown above in which the interlocking features consisted of an indentation on the top surface of the roof tile and a protrusion on the bottom surface, these features could be reversed, i.e., the indentation could be on the bottom surface and the protrusion on the top surface.

I claim:

1. An assembly of substantially identical roof tiles installed on a sloping roof, each roof tile having a length along the direction of roof slope and a width along a direction transverse to the direction of roof slope, each roof tile having a forward portion overlapping a rear portion of another roof tile along horizontally extending joints to form a roof tile assembly, said roof tile comprising a forward portion having an exposed top surface, a tapered forward end terminating at a forward end surface, and a bottom surface;

a rear portion integral with said forward portion and having a top surface which is shaped to be overlapped by another roof tile;

a wind-uplift-preventing step at the junction between the top surface of said forward portion and the top surface of said rear portion, said wind-uplift-preventing step being shaped to shield from the wind the forward end surface of another roof tile to provide a recess configured to work in conjunction with the forward end surface of an adjoining tile to retard upward lifting of the forward end of that adjoining tile; and the wind-uplift-preventing step and the tapered forward end of the roof tile being configured so that in an assembly of said roof tiles the step shields an adjacent forward end surface across substantially the entire width of the tile, thereby reducing the tendency of the roof tile to be uplifted by wind entering beneath the forward portion of a tile;

wherein for each roof tile the bottom surface of said forward portion has a first interlocking formation and said top surface of the rear portion has a second interlocking formation shaped to interlock with an interlocking formation substantially identical to said first interlocking formation on the bottom surface of the forward portion of another roof tile;

wherein for each roof tile said first interlocking formation is a downwardly extending protuberance and said second interlocking formation is an upwardly facing indentation shaped to receive a downwardly extending protuberance substantially identical to said downwardly extending protuberance;

wherein each roof tile further comprises a lateral protuberance extending along a first side of said tile from said forward portion to said rear portion;

a lateral indentation extending along a second side of said tile from said forward portion to said rear portion, said lateral indentation being shaped to interlock with an interlocking formation substantially identical to said lateral protuberance on another roof tile;

wherein adhesive is applied between the first and second interlocking formations of adjoining roof tiles and at the junction of the forward end surface and wind-uplift-preventing step;

wherein for each roof tile said wind-uplifting-preventing step and said forward end surface are shaped so that after installation one of a portion of said forward end surface of said roof tile and adhesive applied at the joint between the forward end surface and wind-uplift-preventing step is captured vertically beneath a portion of a step on a second roof tile, which step is substantially identical to said wind-uplift-preventing step, thereby preventing said roof tile from being vertically lifted by the wind; and wherein said tiles and said first and second interlocking formations are Shaped and positioned so that water flowing down the assembly of tiles on said sloped roof does not flow along or through any of said formations.

2. The assembly of roof tiles of claim 1 wherein for each roof tile said forward end surface is shaped to extend into said recess formed by said wind-uplift-preventing step.

3. The assembly of roof tiles of claim 2 wherein for each roof tile the forward end surface and wind-uplift-preventing step are inclined surfaces, each inclined so that in said assembly of tiles the inclined surfaces are substantially parallel.

4. The assembly of roof tiles of claim 1 wherein each tile is made from a masonry material.

5. The assembly of roof tiles of claim 1 wherein for each roof tile the wind-uplift-preventing steps and the forward end surfaces are shaped and configured so that there are substantially no spaces into which air can enter at the junctions between the wind-uplift-preventing steps and the forward end surfaces.

6. The assembly of roof tiles of claim 1 wherein the wind-uplift-preventing steps shield the joints between the bottom and top surfaces of overlapping tiles, thereby preventing wind from entering at the joint and separating the tiles.

7. The assembly of roof tiles of claim 1 wherein adhesive applied between said tiles blocks entry of water into spaces between said first and second interlocking formations.

8. The assembly of roof tiles of claim 1 wherein for each roof tile the downwardly-extending protuberance and upwardly facing indentation extend transversely across substantially the full width of the tile.

9. The assembly of roof tiles of claim 8 wherein for each roof tile the downwardly extending protuberance has a dimension along the length of said tile of between 0.5 and 2.0 inches.

10. The assembly of roof tiles of claim 8 wherein for each roof tile the downwardly extending protuberance has a depth of between 0.25 and 1.0 inches.

11. An assembly of substantially identical roof tiles installed on a sloping roof, each roof tile having a length along the direction of roof slope and a width along a direction transverse to the direction of roof slope, each roof tile having a forward portion overlapping a rear portion of another roof tile along horizontally extending joints to form a roof tile assembly, said roof tile comprising a forward portion having an exposed top surface, a tapered forward end terminating at a forward end surface, and a bottom surface;

a rear portion integral with said forward portion and having a top surface which is shaped to be overlapped by another roof tile;

a wind-uplift-preventing step at the junction between the top surface of said forward portion and the top surface of said rear portion, said wind-uplift-preventing step being shaped to shield from the wind the forward end surface of another roof tile to provide a recess configured to work in conjunction with the forward end surface of an adjoining tile to retard upward lifting of the forward end of that adjoining tile; and the wind-uplift-preventing step and the tapered forward end of the roof tile being configured so that in an assembly of said roof tiles the step shields an adjacent forward end surface across substantially the entire width of the tile, thereby reducing the tendency of the roof tile to be uplifted by wind entering beneath the forward portion of a tile;

wherein for each roof tile said wind-uplifting-preventing step and said forward end surface are shaped so that after installation one of a portion of said forward end surface of said roof tile and adhesive applied at the joint between the forward end surface and wind-uplift-preventing step is captured vertically beneath a portion of a step on a second roof tile, which step is substantially identical to said wind-uplift-preventing step, thereby preventing said roof tile from being vertically lifted by the wind.

* * * * *

UNITED STATES PATENT AND TRADEMARK OFFICE

CERTIFICATE OF CORRECTION

PATENT NO. : 5,540,029

DATED : July 30, 1996

INVENTOR(S) : Albert S. Elias

It is certified that error appears in the above-identified patent and that said Letters Patent is hereby corrected as shown below:

Cover page, under [56] References Cited, U.S. PATENT DOCUMENTS, the "Kester" reference, "4/1970" should be --4/1910--.

Col. 8, line 14, "Shaped" should be --shaped--.

Col. 8, line 58, "said" should be --each--.

Col. 9, line 14, insert the following:

--the bottom surface of said forward portion having a first interlocking formation and said top surface of the rear portion having a second interlocking formation shaped to interlock with an interlocking formation substantially identical to said first interlocking formation on the bottom surface of the forward portion of another roof tile;--.

Col. 10, line 3, after "installation", delete "one of".

Col. 10, lines 4-6, delete "and adhesive applied at the joint between the forward end surface and wind-uplift-preventing step".

Signed and Sealed this

Fifth Day of November, 1996

*Attest:*

*Attesting Officer*

Bruce Lehman

BRUCE LEHMAN

*Commissioner of Patents and Trademarks*